US005657799A

United States Patent [19]

Kusakari et al.

[11] Patent Number: 5,657,799

[45] Date of Patent: Aug. 19, 1997

[54] SAFETY DEVICE IN REINFORCING BARS BINDING MACHINE

[75] Inventors: Ichiro Kusakari; Atsushi Miyazaki, both of Tokyo, Japan

[73] Assignee: Max Co., Ltd., Tokyo, Japan

[21] Appl. No.: 573,055

[22] Filed: Oct. 17, 1995

[30] Foreign Application Priority Data

Oct. 17, 1994 [JP] Japan ..... 6-276975
Jun. 30, 1995 [JP] Japan ..... 7-188122

[51] Int. Cl.[6] ..... B21F 15/04

[52] U.S. Cl. ..... 140/119; 140/57

[58] Field of Search ..... 140/57, 93 A, 140/93.6, 119

[56] References Cited

U.S. PATENT DOCUMENTS 4,685,493 8/1987 Yuguchi ..... 140/119

FOREIGN PATENT DOCUMENTS 0 190 071 8/1986 European Pat. Off. .
0 249 737 12/1987 European Pat. Off. .
24 54 905 6/1976 Germany .

*Primary Examiner*—Lowell A. Larson
*Attorney, Agent, or Firm*—Cushman Darby & Cushman Intellectual Property Group of Pillsbury Madison & Sutro LLP

[57] ABSTRACT

A safety device for a reinforcing bars binding machine which includes a wire feed device for feeding out a wire used to bind reinforcing bars together, a guide arm for guiding the fed-out wire such that the wire is wound around the intersecting portions of the reinforcing bars in a loop manner, a twisting device for holding part of the loop-wound portion of the wire and for twisting and rotating the same to thereby tighten the wire, and a cutting device for cutting off the loop-wound portion of the wire from the portion of the wire existing on the wire feed device side, wherein the guide arm is movable in the wire feeding direction, and wherein the safety device comprises: a spring normally energizing the guide arm in the opposite direction to the wire feeding direction; and detector for detecting that the guide arm is moved in the wire feeding direction against the energization force of the spring, wherein the wire feeding device is operated in accordance with the detection of the movement of the guide arm by the detector.

4 Claims, 10 Drawing Sheets

SAFETY DEVICE IN REINFORCING BARS BINDING MACHINE

BACKGROUND OF THE INVENTION

1. Field of the Invention

The present invention relates to a reinforcing bars binding machine which plays out a binding wire in a loop manner from a curved guide arm, winds it a plurality of times around the intersecting portions of reinforcing bars and, after then, twists part of the loop-wound portion of the binding wire to thereby tighten the wire and, in particular, to a safety device for use in such reinforcing bars binding machine.

2. Description of the Related Art

Generally, in placing reinforced concrete on a building or a structure, after reinforcing bars which intersect each other crosswise are bound together with a wire, the concrete is placed. Recently, the reinforced concrete has been bound by use of a reinforcing bar binding machine. A reinforcing bars binding machine of this type is disclosed in Japanese Patent Application Laid-open No. Hei. 4-40686 which is applied by the present applicant. In this reinforcing bars binding machine, a main switch is previously turned on, when binding together the reinforcing bars, a trigger is pulled to thereby feed out a wire, the wire is played out in a loop manner from the leading end curved portion of a guide arm and is wound around the intersecting portions of reinforcing bars, and, after then, part of the loop-shaped portion the wire is hitched on a twisting hook and is then twisted and rotated to thereby tighten the wire so as to bind the reinforcing bars to each other efficiently.

In another reinforcing bars binding machine of this type, as disclosed in Japanese Utility Model Application Laid-open No. Hei. 5-3494 which is applied by the present applicant, after a wire is wound around the reinforcing bars in a loop manner, part of the loop-wound portion of the wire is held by a hook and is then rotated and twisted to thereby tighten the winding of the wire around the reinforcing bars, so that the reinforcing bars can be bound and fixed together strongly.

However, in the conventional reinforcing bars binding machines thus structured, if a main switch is previously on, then the binding machine is allowed to start automatically only by pulling a trigger, unexpected accidents can happen: for example, when an operator moves from one site to another with his or her fingers remaining put on the trigger, a wire can be fed out suddenly or a hook can be rotated suddenly to thereby hurt the operator, or as the result that the operator is surprised at such sudden wire feeding out or hook rotation, the operator can be hurt.

SUMMARY OF THE INVENTION

The present invention aims at eliminating the above drawbacks found in the conventional reinforcing bars binding machine. Accordingly, it is an object of the invention to provide a safety device which, for use in a reinforcing bars binding machine, prevents the binding machine from starting even if a trigger is pulled by mistake or carelessly.

In attaining the above object, according to a first aspect of the invention, for use in a reinforcing bars binding machine which comprises a wire feed device for feeding out a wire used to bind reinforcing bars to each other, a guide arm for guiding the fed-out wire in such a manner that the wire can be wound around the intersecting portions of the reinforcing bars in a loop manner, a twisting device for holding part of the loop-wound portion of the wire and for twisting and rotating the same to tighten the wire, and a cutting device for cutting the loop-wound portion of the wire from the portion of the wire existing on the wire feed device side, wherein the guide arm is movable in the wire feeding direction, there is provided a safety device which comprises: a spring normally energizing the guide arm in the opposite direction to the wire feeding direction; and detector for detecting that the guide arm is moved in the wire feeding direction against the energization force of the spring, wherein the wire feeding device is operated in accordance with the detection of the movement of the guide arm by the detector.

According to a second aspect of the invention, there is provided a safety device for a reinforcing bars binding machine in which a wire fed out from a wire feed device is wound around reinforcing bars in a loop manner, and the wire is held and twisted by a twisting hook to thereby tighten the winding of the wire around the reinforcing bars so as to strongly bind the reinforcing bars together, the safety device comprising: a contact member engageable with the reinforcing bars when the reinforcing bars are to be bound together, the contact member being movable back and forth; a spring normally energizing the contact member forwardly; and a switch member which, when the contact member is moved backwardly, is engaged with the contact member to thereby allow the binding machine to be operated.

According to a third aspect of the invention, the safety device described above, wherein the contact member comprises two contact elements which are respectively disposed on the right and left sides of the safety device, the switch member comprises two switches which are respectively arranged such that they can be engaged with their respective contact elements, and the binding machine can be operated only when both of the switches are engaged with their respective contact elements.

According to the invention, while the leading end curved portion of the guide arm is put or hitched on the intersecting portions of the reinforcing bars, the main body of the binding machine is pulled to thereby move the guide arm relatively in the wire feeding direction against the energization force of the spring, before the micro-switch can be turned on. In addition to this guide arm pulling operation, if the trigger is pulled, then the switch of the wire feed device can be put into operation so that the wire wound around a spool can be played out before the guide arm. And, the wire can be wound by the guide arm around the intersecting portions of the reinforcing bars in a loop manner.

After then, part of the loop-wound portion of the wire is held by the twisting device and is then twisted and rotated by the same device to thereby tighten the wire, and the portion of the wire existing on the wire feed device side is cut off from the binding portion or loop-wound portion of the wire by the cutting device.

In the second aspect, if the contact means is engaged with the reinforcing bars to thereby press the reinforcing bars binding machine against the reinforcing bars, then the contact means it moved back backwardly against the energization force of the spring, so that the switch means detects the reinforcing bars and thus turns on, thereby enabling the binding machine to be operated. If the binding machine is operated, then the wire fed out from the wire feed device is wound around the reinforcing bars in a loop manner, and part of the loop-wound portion of the wire is held and twisted by the twisting hook to thereby tighten the winding of the wire around the reinforcing bars, so that the reinforcing bars can be bound together strongly.

As described above, the contact means must be pressed against the reinforcing bars before the binding machine can be operated and, therefore, the unexpected operation of the binding machine can be prevented effectively to thereby secure the safety of the operator.

In the third aspect, for example, if, as the result that the binding machine is pressed obliquely against the reinforcing bars, only one switch can be turned on, then the binding machine is prevented from being operated. This prevents the reinforcing bars from being bound together incompletely and thus makes it possible to strongly bind the reinforcing bars together all the times.

DETAILED DESCRIPTION OF THE PREFERRED EMBODIMENTS

Figure 1:
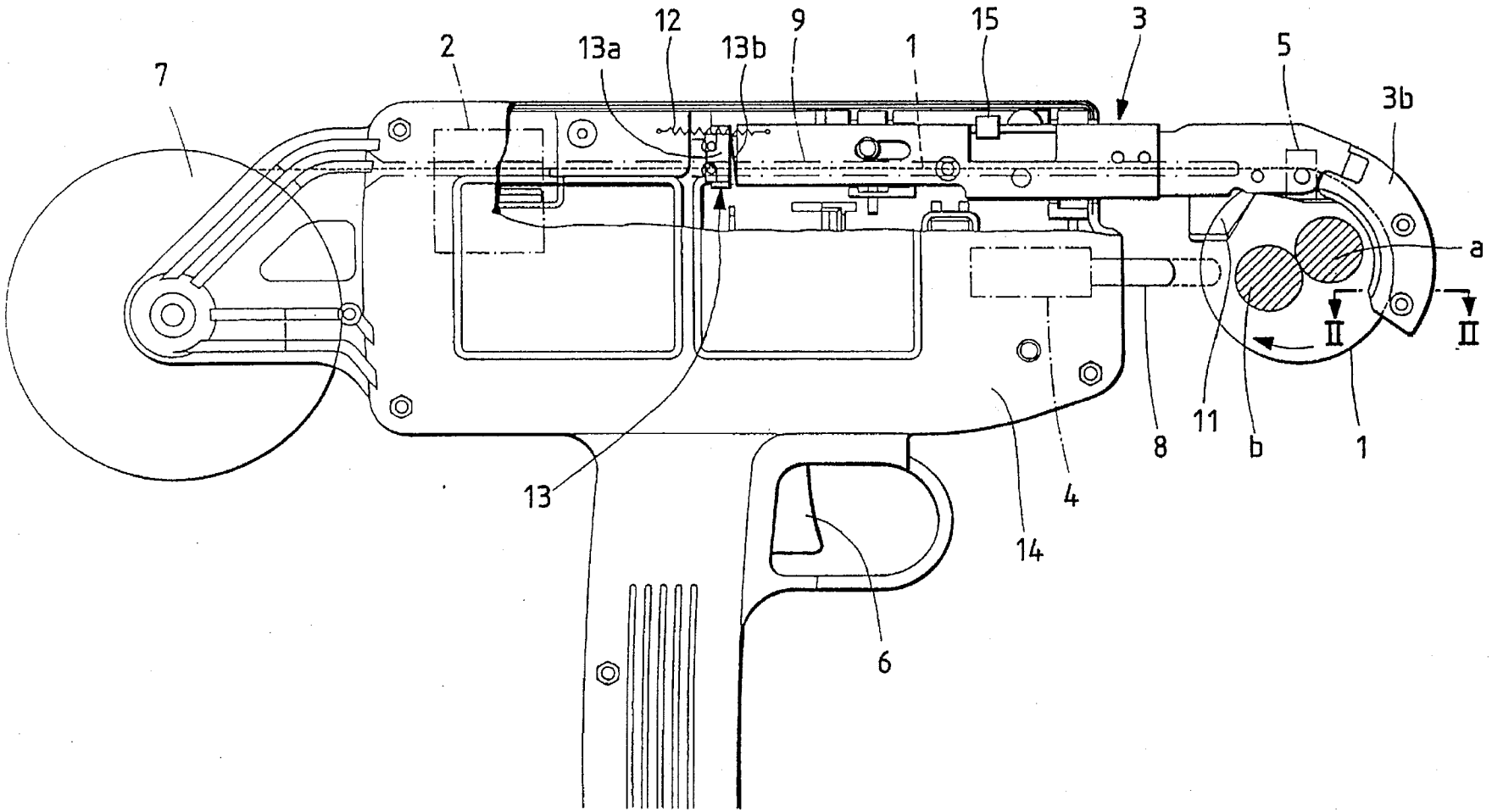
FIG. 1 is a partially broken side view of a reinforcing bars binding machine according to the invention.

Now, FIG. 1 shows the main portions of a reinforcing bars binding machine which includes a wire feed device 2 for feeding out forwardly a wire 1 which is wound around a spool 7, a guide arm 3 for guiding the fed-out wire 1 to be wound in a loop manner, a twisting device 4 for holding and twisting part of the loop-wound portion of the wound wire 1 to thereby tighten the wire, and a cutting device 5 for cutting off the loop-wound portion of the wire from the base portion of the wire 1. The wire feed device 2, twisting device 4 and cutting device 5 are respectively provided in the main body of the binding machine and can be operated with a motor.

In the above-mentioned reinforcing bars binding machine, a main switch is previously turned on, and, in binding the reinforcing bars, if a trigger 6 is pulled, then the wire 1 is fed out from the spool 7 by the wire feed device 2 and is then wound in a loop manner by the guide arm 3; and, after then, part of the loop-wound portion of the wire 1 is held by a hook 8 is twisted and rotated to thereby bind together the reinforcing bars, and the loop-wound wire portion is cut off from the base portion of the wire 1 by use of the cutting device 5.

Figure 2:
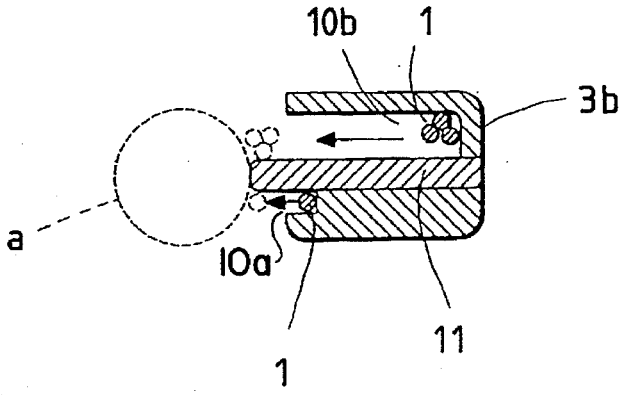
FIG. 2 is a section view taken along the line II—II shown in FIG. 1.

Here, the leading end portion of the guide arm 3 used to guide and wind the wire 1 in a loop manner is curved in an arc shape, while the base portion 3*a* of the guide arm is connected to a feed passage 9 for the wire 1 fed by the wire feed device 2. And, in the curved portion 3*b* of the guide arm 3, there are formed a first guide groove 10*a* and a second guide groove 10*b* which guide the wire 1 in such a manner as shown in FIG. 2, while the first and second guide grooves 10*a* and 10*b* are disposed in parallel to each other with a partition wall serving as a guide piece 11 between them and are respectively opened inwardly of the curved portion 3*b*. Also, in the boundary area between the feed passage 9 and first guide groove 10*a*, there is arranged the cutting device 5 for cutting the wire 1.

The first guide groove 10*a* is formed continuously with the feed passage 9 for the wire 1, has a groove width slightly larger than one piece of wire 1, and is used to apply a given kind of curving tendency to the wire 1 when the wire 1 is played out from the curved portion 3*b* of the guide arm 3. Therefore, the wire 1 that is played out from the curved portion 3*b* is successively allowed to have a curving tendency of a given curvature so that the wire 1 can circulate around the reinforcing bars in a loop manner.

The guide arm 3 includes the guide piece 11 by which the leading end of the wire 1 after one circulatory motion thereof can be guided into the second guide groove 10*b*.

And, the guide arm 3 is mounted on the binding machine main body 14 in such a manner that it is free to move in the feeding direction of the wire 1, and also that it is normally energized by a spring 12 in the opposite direction to the wire 1 feeding direction.

Figure 3:
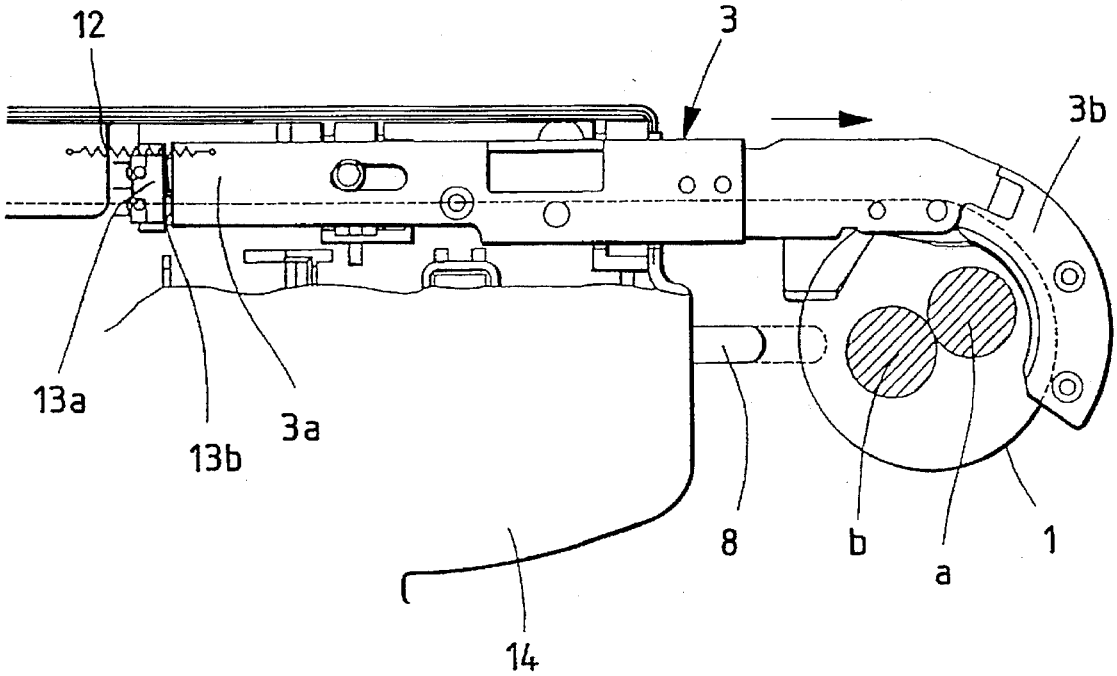
FIG. 3 is an explanatory view of the operation of a guide arm employed in the above reinforcing bars binding machine.

Also, a micro-switch 13 is fixed at a position adjacent to the base end of the guide arm 3 of the binding machine main body 14. The micro-switch 13 includes an operative piece 13*b* which is normally in engagement with the base end of the guide arm and is thus pushed into the switch main body 13*a* side. When the guide arm 3 is moved in the wire 1 feeding direction as shown in FIG. 3, then the operative piece 13*b* is put into operation to thereby be able to turn on the switch.

Figure 4:
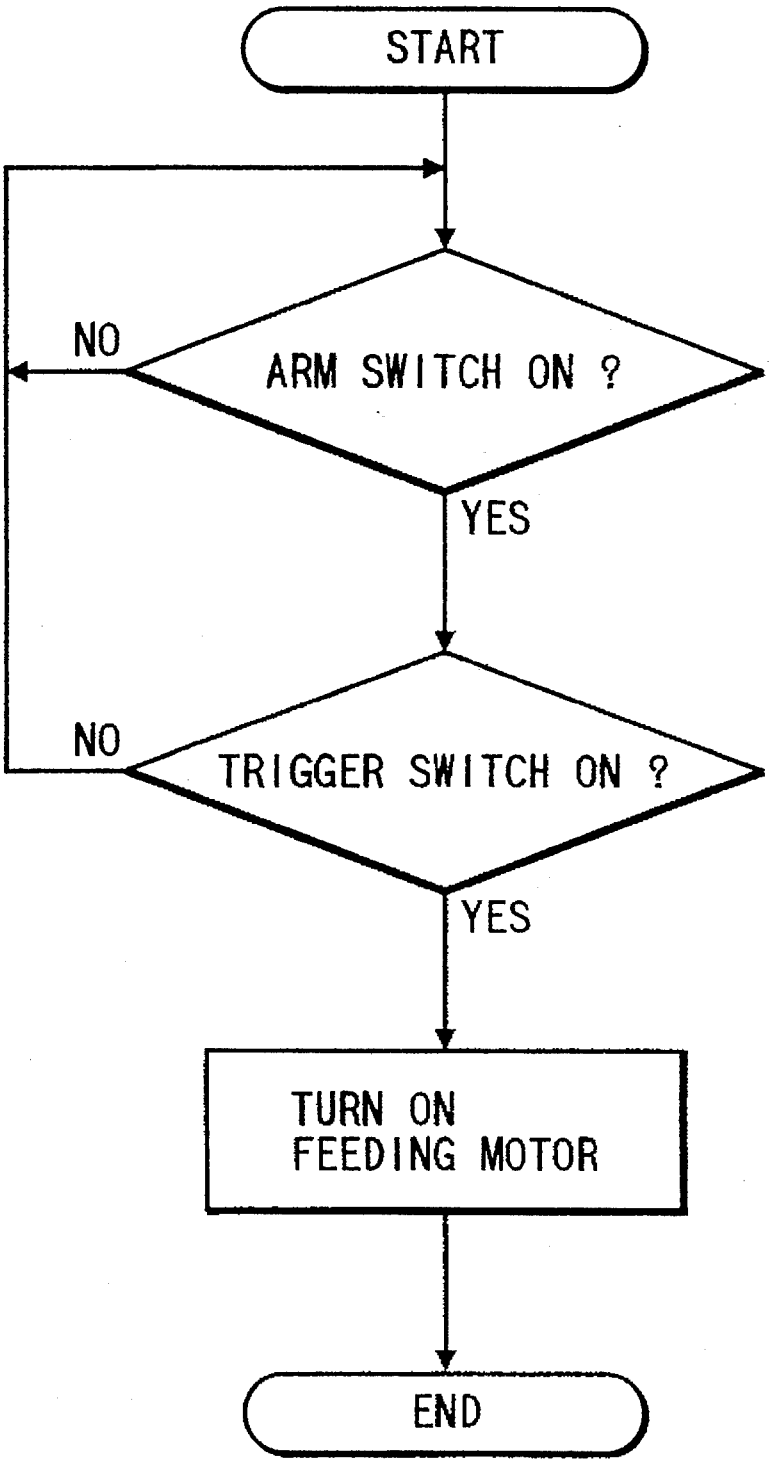
FIG. 4 is a flow chart of the operating condition of a wire feed device employed in the invention.

The micro-switch 13 is disposed in a drive circuit of the binding machine, while the main switch is connected in series to a start switch which can be operated by the trigger 6. Therefore, as shown in FIG. 4. The wire feed device 2 can be operated only in accordance with both the detection of the movement of the guide arm 3 by the micro-switch 13 and the turn-on of the start switch by the trigger 6.

Also, the binding machine main body 14 further includes lock means 15. The lock means 15 is normally engaged into an engaging groove formed in the guide arm 3 to lock the guide arm 3 so that the guide arm 3 is prevented from moving in the wire feeding direction, whereas the lock means 15 can be removed from its locking state by the pulling operation of the trigger 6.

According to the reinforcing bars binding machine structured in the above-mentioned manner, if the leading end curved portion 3*b* of the guide arm 3 is hitched on the intersecting portions of the reinforcing bars a and b and the binding machine main body 14 is then pulled, then the guide arm 3 can be moved relatively in the wire 1 feeding direction against the energization force of the spring 12. This turns on the micro-switch 13. In addition to the pulling operation of the guide arm 3, if the trigger 6 is pulled, then the switch of the wire feed device 2 is put into operation so that the wire 1 wound around the spool 7 is played out before the guide arm 3. And, the leading end of the wire 1, which has been wound as a first circulation in a loop manner around the intersecting portions of the two reinforcing bars a and b by the first guide groove 10*a* of the guide arm 3, is guided in its second circulation into the second guide groove 10*b* by the guide piece 11 of the guide arm 3, and, similarly to the first circulation, it is guided in a loop manner. Further, at and from the third and fourth circulations, similarly, the leading end of the wire 1 is guided into the second guide groove 10*b* by the guide piece 11. And, the portions of the respective circulations of the wire 1 are allowed to move out through an opening formed inside the first and second guide grooves 10*a* and 10*b*, and are then wound around the intersecting portions of the reinforcing bars a and b. If the wire feed device 2 is caused to stop and the cutting device 5 is operated to cut off the wire 1 portion existing within the first guide groove 10*a* of the guide groove 3 after the wire 1 has run three or four times around the peripheries of the reinforcing bars a and b, then the twisting device 4 is operated at the same time so that the twisting hook 8 holds part of the loop-wound portion of the wire 1 and then twists and rotates the same. Due to this, the loop-wound wire portion fastens strongly the intersecting portions of the two reinforcing bars a and b.

As described above, since the wire feed device 2 is operated with the curved portion 3*b* of the guide arm 3 hitched on the intersecting portions of the reinforcing bars a and b, as shown in FIG. 2, as soon as it comes out of the inside opening of the curved portion 3*b*, the wire 1 is abutted against the reinforcing bars a and b to thereby eliminate a possibility that any clearance can be produced between the wire 1 and the two reinforcing bars a and b. This prevents the wire 1 from being loosened and thus the tightening of the wire 1 when the wire 1 is twisted by the twisting device 4 can be carried out efficiently, which makes it sure to be able to bind the two reinforcing bars a and b to each other.

On the other hand, if the guide arm 3 is not pulled but only the trigger 6 is operated, the guide arm 3 cannot be moved and, therefore, the micro-switch 13 remains off, so that the wire feed device 2 will not be operated at all.

Although in the illustrated embodiment, the micro-switch 13 is used to detect that the guide arm 3 is moved to the wire 1 feeding side against the energization force of the spring 12, means for detecting the movement of the guide arm 3 is not limited to the micro-switch 13. For example, there can be used a light sensor which detects the shielding of the light occurring when the end portion of the guide arm 3 is moved.

Figure 5:
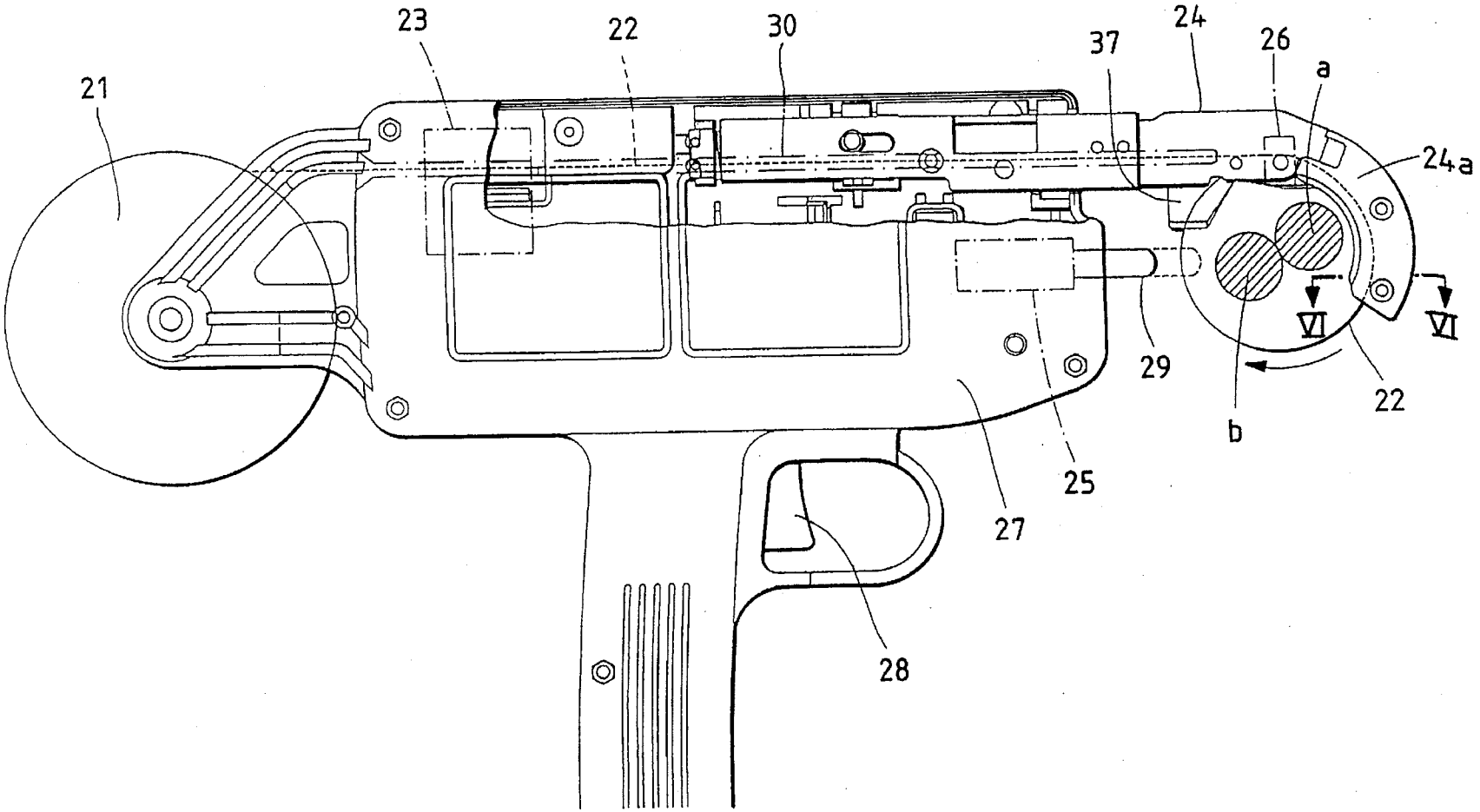
FIG. 5 is a partially broken side view of another reinforcing bars binding, machine according to the invention.

Now, FIG. 5 shows the main portions of a reinforcing bars binding machine according to the second embodiment which includes a wire feed device 23 for feeding out forwardly a wire 22 wound around a spool 21, a guide arm 24 for guiding the fed-out wire 22 such that the wire 22 can be wound around the intersecting portions of reinforcing bars a and b in a loop manner, a twisting device 25 for holding and twisting part of the loop-wound portion of the thus wound wire 22 to thereby tighten the winding of the wire 22 around the reinforcing bars a and b, and a cutting device 26 for cutting off the loop-wound portion of the wire 22 from the base portion of the wire 22. The wire feed device 23, twisting device 25 and cutting device 26 are disposed in a binding machine main body 27 and can be operated by a motor (not shown).

In the above-mentioned reinforcing bars binding machine, while a main switch is previously turned on and remains on, when binding the reinforcing bars together, if a trigger 28 is pulled, the wire 22 is fed out from the spool 21 by the wire feed device 23 and is then wound around the reinforcing bars in a loop manner by the guide arm 24, and, after then, the loop-wound portion of the thus wound wire 22 is in part held and rotated by a twisting hook 29 provided in the twisting device 25 to thereby bind the reinforcing bars together with the wire 22, while the loop-wound portion of the wire 22 is cut off from the base portion of the wire 22 by the cutting device 26.

Figure 6:
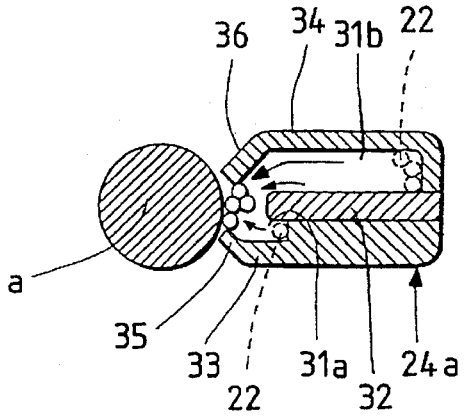
FIG. 6 is a section view taken along the line VI—VI shown in FIG. 5.
Figure 7:
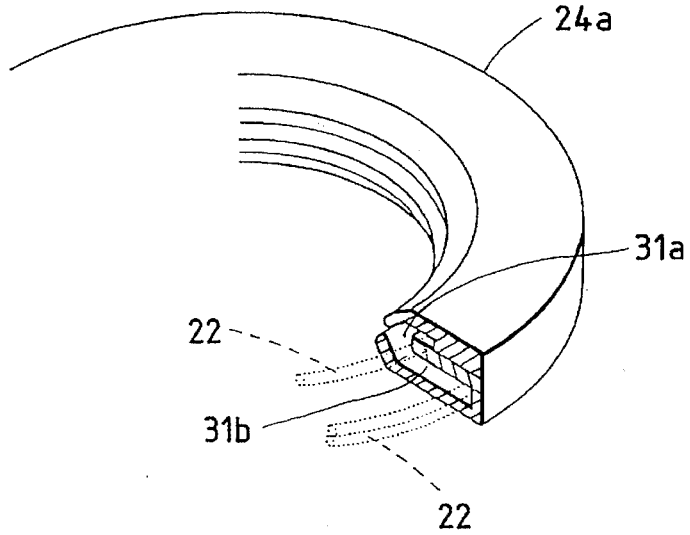
FIG. 7 is a perspective view of a curved porion of a guide arm in the reinforcing bars binding machine.
Figure 8:
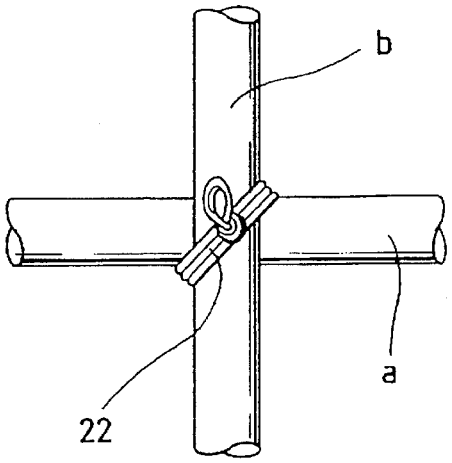
FIG. 8 is an explanatory view of the bound condition by the reinforcing bars binding machine.

Here, the guide arm 24, which guides the wire 22 around the reinforcing bars, includes a leading end which is curved in an arc shape, while the base portion side of the guide arm 24 is connected with a feed passage 30 for the wire 22 that is fed by the wire feed device 23. And, in the curved portion 24*a* of the guide arm 24, as shown in FIGS. 6 and 7, there are formed a first guide groove 31*a* and a second guide groove 31*b* for guiding the wire 22, which are arranged in parallel to each other with a partition wall 32 between them and are respectively opened inwardly of the curvature of the curved portion 24*a*. And, in the boundary area between the feed passage 30 and the first guide groove 31*a*, there is arranged the cutting device 26 which is used to cut off the wire 22.

The first guide groove 31*a* is a groove which is formed continuous with the feed passage 30 for the wire 22, and the groove width of the first guide groove 31*a* is set slightly larger than the diameter of one piece of wire 22 so as to be able to apply a given curving tendency to the wire 22 when it is played out from the curved portion 24*a* of the guide arm 24. Therefore, the wire 22 that is played out from the cured portion 24*a* is successively given a curving tendency of a give curvature so that the wire 22 is allowed to run around the reinforcing bars in a loop manner.

On the other hand, the second guide groove 31*b* is a groove which is used to guide the loop-winding of the wire 22 after the wire 22 has run once around the reinforcing bars, in particular, the second and its following loop-windings of the wire 22, while the groove width of the second guide groove 31*b* is formed wider than that of the first guide groove 31*a*. Also, each of the second and its following loop-windings of the wire 22 becomes slightly larger than the first loop-winding of the wire 22 due to the return of the wire 22 and, for this reason, the diameter of each of the second and its following loop-windings of the wire 22 is larger than the first guide groove 31*a*.

Next, the first and second guide grooves 31*a* and 31*b* respectively include side walls 33 and 34 which are respectively opposed to the partition wall 32. The side walls 33 and 34 are projected inwardly of the curvature of the curved portion 24*a*, while the projecting portions thereof 35 and 36 are disposed adjacent to each other. That is, the projecting portion 35 of the side wall 33 on the first guide groove 31*a* side is arranged so as to come near to the second guide groove 31*b* side, while the projecting portion 36 of the side wall 34 on the second guide groove 31*b* side is arranged so as to come near to the first guide groove 31*a* side. Therefore, the whole groove, which is obtained by combining the first guide groove 31*a* with the second guide groove 31*b*, is formed such that it is wide in the inner part thereof and is narrow in the frontage thereof.

Further, in the guide arm 24, there is formed a V-shaped guide piece 37 which is used to guide the leading end of the wire 22, which has been wound once, into the second guide groove 31*b*.

According to the reinforcing bars binding machine of the second embodiment, if the trigger 28 is pulled with the leading end curved portion 24*a* of the guide arm 24 hitched on the intersecting portions of the reinforcing bars a and b, then the wire feed device 23 is operated so that the wire 22 wound around the spool 21 is played out before the guide arm 24. And, after the wire 22 has been wound once around the intersecting portions of the reinforcing bars a and b in a loop manner by the first guide groove 31*a* of the guide arm 24, the leading end of the wire 22, when it is wound for the second time, is guided into the second guide groove 31*b* by the guide piece 37 of the guide arm 24 and is further guided such that it is wound around the reinforcing bars in a loop shape similarly to the first winding. Further, on the third, fourth windings and following windings, the wire 22 is similarly guided into the second guide groove 31*b* by the guide piece 37. And, the respective windings of the wire 22 are moved through an opening formed inside the projecting portions 35 and 36 of the side walls 33 and 34 of the first and second guide grooves 31*a* and 31*b* and are then wound around the intersecting portions of the reinforcing bars a and b. Since the projecting portions 35 and 36 are formed so as to be adjacent to each other, the loop-wound portions of the wire 32 moved out from the first and second guide grooves 31*a* and 31*b* are made to come near to each other so that they can be united well as a whole. And, after the wire 22 has run three or four times around the peripheries of the reinforcing bars a and b, the wire feed device 23 is caused to stop, and the cutting device 26 is operated to cut off the portion of the wire 22 existing within the first guide groove 31*a* of the guide arm 24. Simultaneously with the cutting operation of the cutting device 26, the twisting device 25 is operated so that the twisting hook 29 of the twisting device 25 holds and rotates twistingly part of the loop-wound portion of the wire 22. As a result of this, the loop-wound portion of the wire 22 around the reinforcing bars a and b tightens the intersecting portions of the reinforcing bars a and b strongly.

Figure 9:
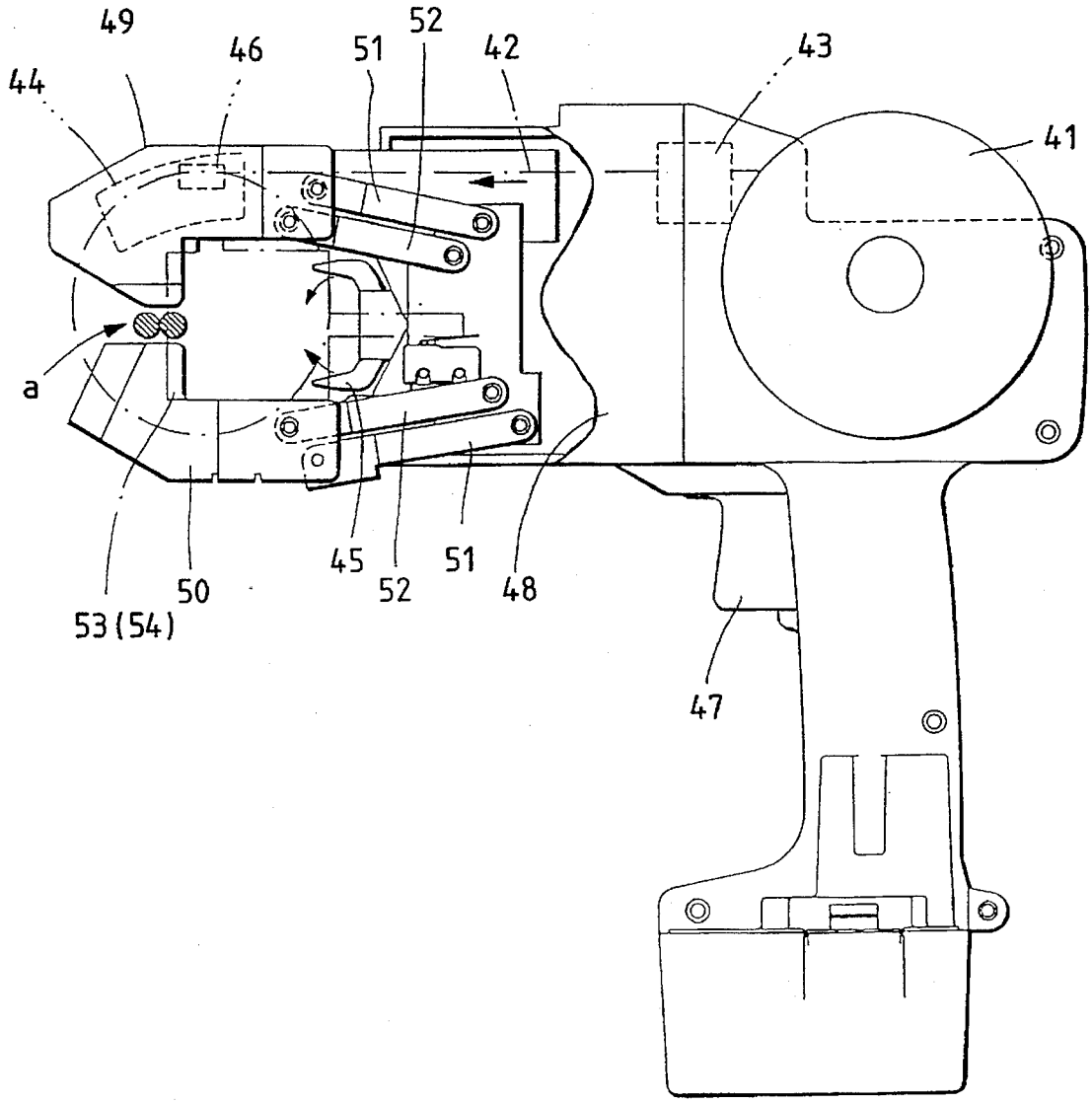
FIG. 9 is a side view of the main portions (excluding a safety device) of another reinforcing bars binding machine according to the invention.

FIG. 9 shows part of the main portions of a reinforcing bars binding machine according to the third embodiment. This reinforcing bars binding machine includes a wire feed device 43 for feeding out forwardly a wire 42 wound around a spool 41, a guide part 44 for guiding the fed-out wire 42 such that the wire 42 can be wound around the intersecting portions of reinforcing bars a in a loop manner, a twisting hook 45 for holding, twisting and tightening the wire 42, and a cutting device 46 for cutting off the loop-wound portion of the wire 42 from the base portion of the wire 42. And, in the binding machine, after the wire 42 fed out from the wire feed device 43 by pulling a trigger lever 47 is wound around the reinforcing bars a in a loop manner and is cut off, part of the loop-wound portion of the wire 42 is held and rotated by the twisting hook 45 to thereby tighten the winding of the wire 42 around the reinforcing bars a, so that the reinforcing bars a can be bound together strongly. The wire feed device 43, twisting hook 45, and cutting device 46 can be operated with a motor (not shown). The structures and operations of these components are basically the same as those disclosed in Hei. 5-3494 previously mentioned.

Next, in the upper and lower portions of the main body 48 of the binding machine, in order to prevent the loop-wound portion of the wire 42 from moving in a direction perpendicular to the diameter direction of the wire 42, there are provided a pair of guide arms 49 and 50 which are disposed opposed to each other and are used to hold inside the wire 42 that has been fed out from the guide part 44 and has gone around the reinforcing bars a in a loop manner.

And, the guide arms 49 and 50 are respectively connected to the binding machine main body 48 through two parallel links 51 and 52, while the distance between the two guide arms 49 and 50 can be adjusted according to the thicknesses of the reinforcing bars.

Figure 10:
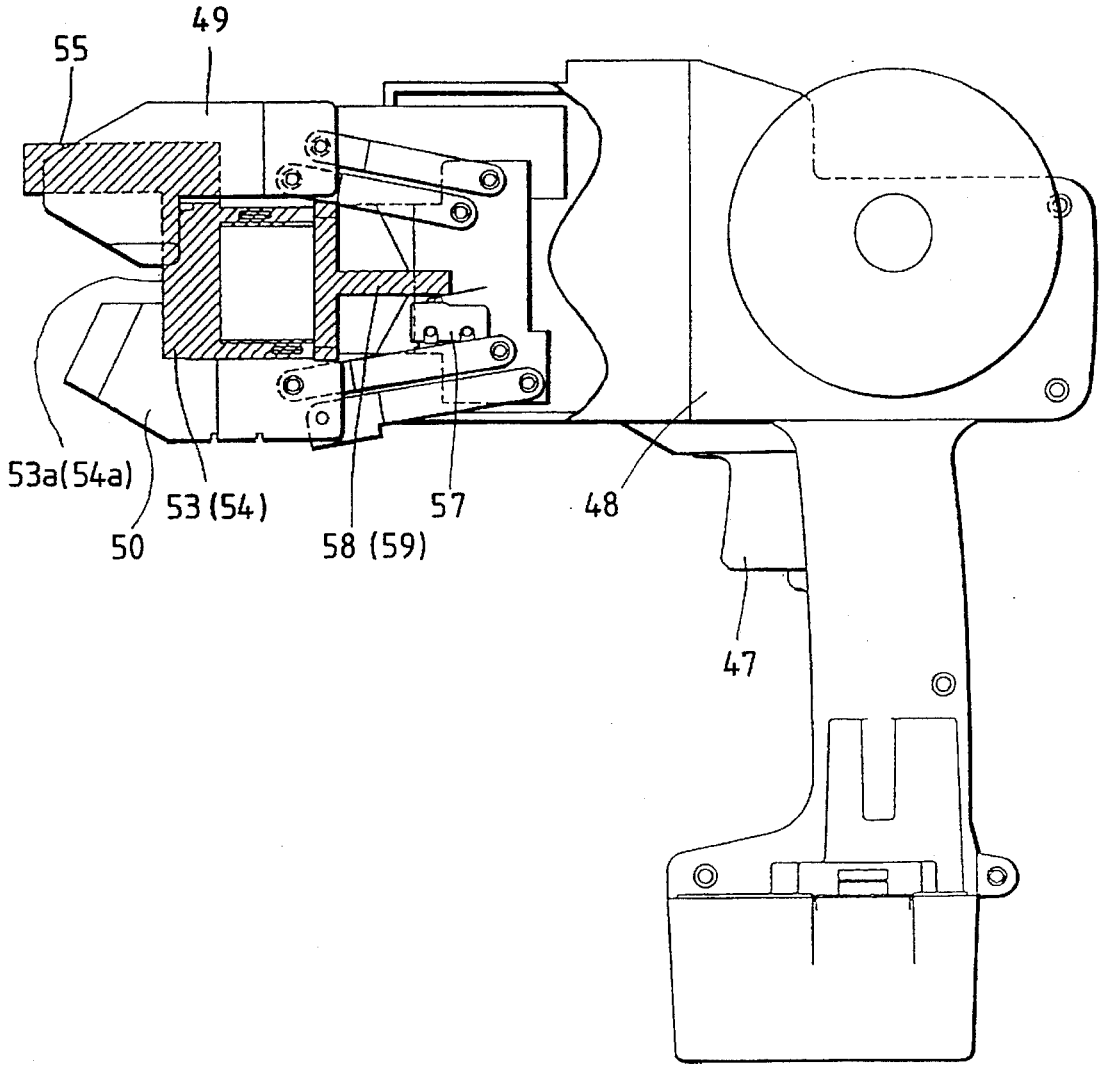
FIG. 10 is a side view of the main portions of the safety device of the above binding machine.
Figure 11:
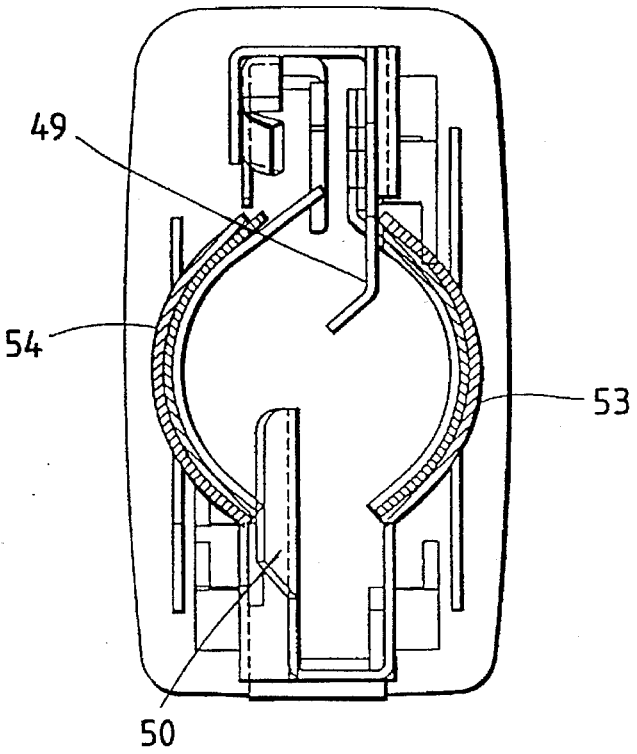
FIG. 11 is a front view of the main portions of the above binding machine.
Figure 12:
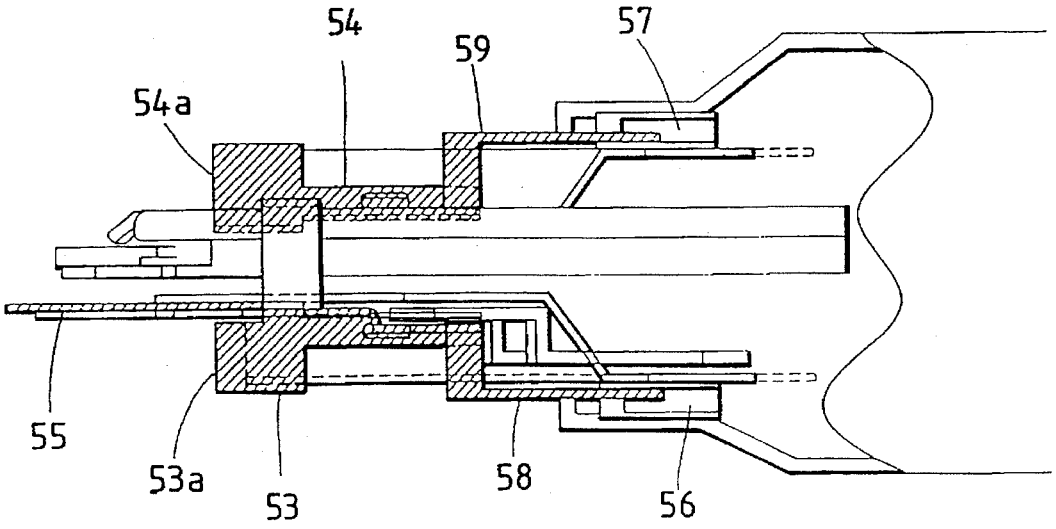
FIG. 12 is a plan view of the main portions of the above binding machine.

Also, as shown in FIGS. 10, 11 and 12, on the two sides of the guide arms 49 and 50, there are disposed contact elements 53 and 54 which are respectively formed in a curved plate and are movable back and forth. The contact elements 53 and 54 are respectively constructed in a three-layer structure, while the respective front ends 53*a* and 54*a* thereof are engageable at given positions with the reinforcing bars introduced from between the guide arms 49 and 50. Also, the contact elements 53 and 54 respectively include in the rear portions thereof operative pieces 58 and 59 which are formed projectingly. Further, the contact elements 53 and 54 are normally energized forwardly by a spring (not shown).

And, one contact element 53 includes in the upper portion of the front end thereof a projecting piece 55 which projects forwardly. The front end of the projecting piece 55 is normally projecting more forwardly than the front end of the upper guide arm 49.

On the two sides of the binding machine main body 48, there are provided two switches 56 and 57 which are respectively used to control the operation of the wire feed device 43. As shown in FIGS. 10 and 12, in order that the two switches 56 and 57 enable the binding machine including the wire feed device 43, twisting hook 45 and the like to be operated only when both of the contact elements 53 and 54 are moved and engaged with the reinforcing bars, it is preferred that the two switches 56 and 57 are connected in series with the operation circuit of the binding machine.

Figure 13:
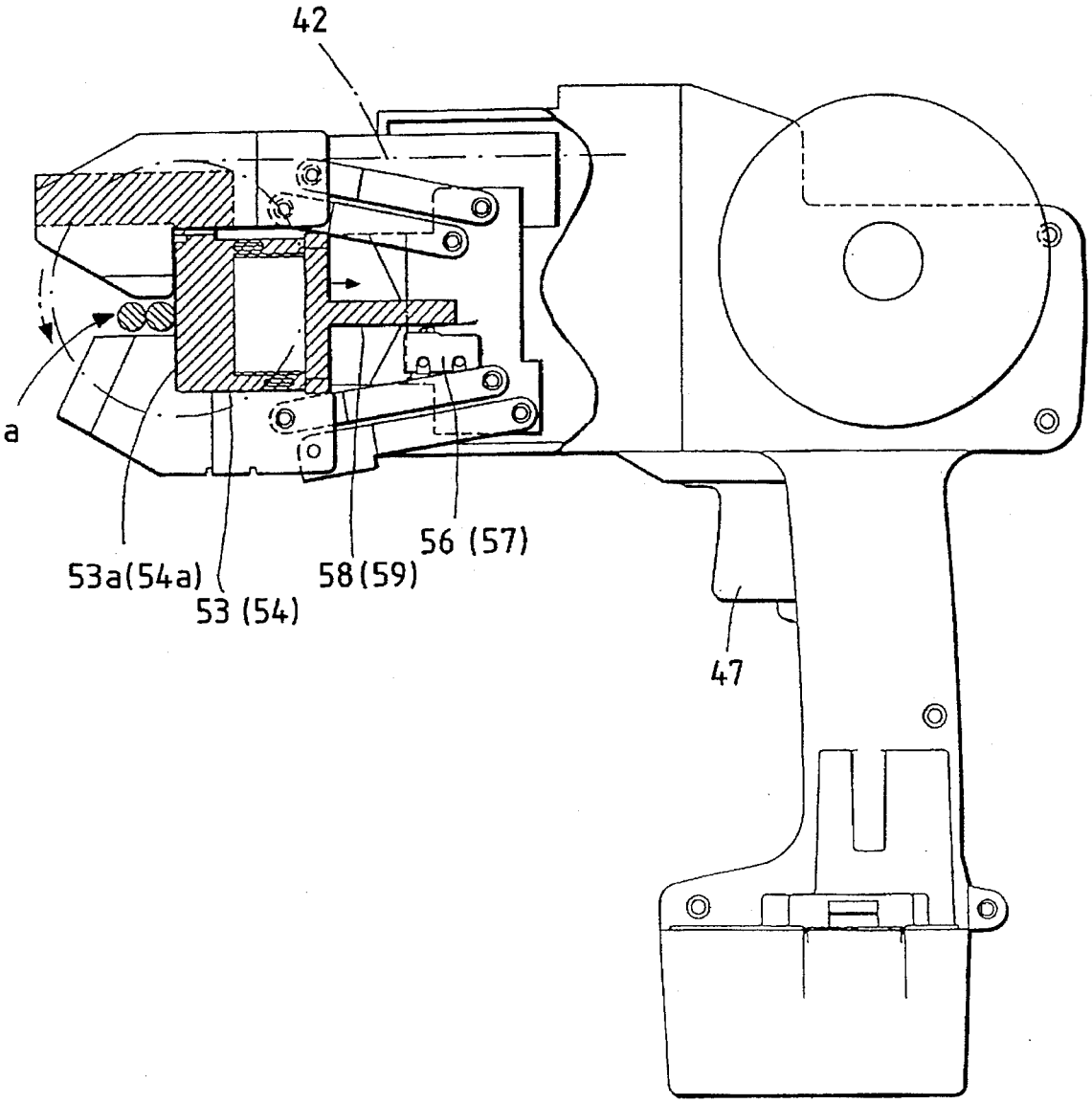
FIG. 13 is an explanatory view of the detection of the reinforcing bars.

The use of the reinforcing bars binding machine thus structured is now described below If the intersecting portions of the reinforcing bars a are introduced from between the guide arms 49 and 50 to thereby move the reinforcing bars binding machine, then the front ends 53*a* and 54*a* of the contact elements 53 and 54 are engaged with the reinforcing bars a, as shown in FIG. 13. If the contact elements 53 and 54 are further pressed against the reinforcing bars a, then the Contact elements 53 and 54 are moved relatively backwardly against the energization fore of the spring and the operative pieces 58 and 59 of the contact elements 53 and 54 are thereby engaged with the switches 56 and 57 to turn them on. Accordingly, the wire feed device 43 and the like are enabled. Here, if the trigger lever 47 is pulled, then, as shown in FIG. 9, the wire feed device 43 is actuated to feed out the wire 42 wound around the spool 41, and the thus fed-out wire 42 is wound two or more times around the intersecting portions of the reinforcing bars a in a loop manner. After then, the wire feed device 43 is stopped and the cutting device 46 is operated to cut off the portion of the wire 42 existing within the guide part 44 and, at the same time, the twisting hook 45 (see FIG. 9) is closed, that is, holds and rotates twistingly part of the loop-wound portion of the wire 42. This allows the wire 42 to strongly tighten its winding around the intersecting portions of the reinforcing bars a. After the reinforcing bars a are tightened and bound together strongly, if the reinforcing bars binding machine is pulled toward the operator, then the twisting hook 45 is removed from the wire 42 and is opened and the reinforcing bars a are kept in their strong bound condition.

When the wire 42 is twisted and rotated by the twisting hook 45 in the above-mentioned manner, the loop-wound portion of the wire 42 receives a force which is going to move the loop-wound portion in a direction perpendicular to the diameter direction thereof but, however, because the loop-wound portion of the wire 42 is retained within the upper and lower guide arms, actually, the loop-wound portion of the wire 42 can never be moved laterally.

Also, in some cases, two concrete panels may be disposed adjacent to the reinforcing bars respectively on the operation side and on the opposite side with the reinforcing bars between them. In such cases, if the front ends 53*a* and 54*a* of the contact elements 53 and 54 are engaged with the reinforcing bars and are then operated, the fed-out wire can be abutted against the concrete panels and thus cannot be used properly. To avoid this, with the projecting piece 55 pressed against the concrete panel, the contact element 53 may be operated.

Figure 14A:
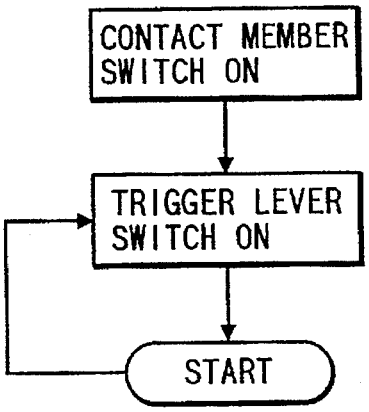
FIGS. 14(*a*) and 14(*b*) are respectively flow charts used to operate the above binding machine; and, FIG. 15 is an explanatory view of the detection of the reinforcing bars when the binding machine is pressed against the reinforcing bars.
Figure 14B:
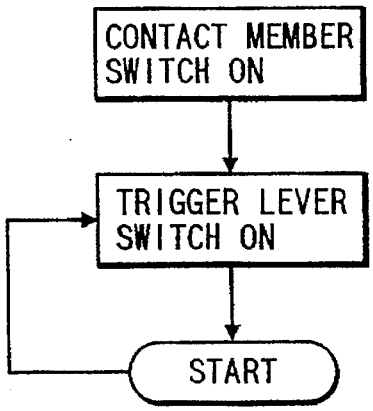

Here, referring to the operation of the reinforcing bars binding machine, the binding machine may be structured in such a manner as shown in FIG. 14(*a*), that is, after the switches 56 and 57 are turned on by pressing the contact elements 53 and 54 against the reinforcing bars a, if the trigger lever 47 is pulled, then the binding operation may be carried out and, after then, if the trigger lever 47 is pulled again, then the binding machine can be operated automatically. Or, the binding machine may be structured as shown in FIG. 14(*b*), that is, if the trigger lever 47 remains pulled, then the binding machine can be operated each time the contact elements 53 and 54 are pressed against the reinforcing bars.

According to the invention, not only the guide arm must be put on the intersecting portions of the reinforcing bars but also the trigger must be pulled, before the present reinforcing bars binding machine can be put into operation and, therefore, even if the trigger is pulled by mistake, the binding machine is prevented from starting its operation, which in turn prevents an unexpected accident from happening, that is, the present binding machine is very safe.

Also, since the wire feed device is operated while the curved portion of the guide arm is being hitched on the intersecting portions of the reinforcing bars a and b, as shown in FIG. 2, as soon as it comes out of the inside opening of the curved portion, the wire is abutted against the reinforcing bars a and b to thereby eliminate a possibility that any clearance can be produced between the wire and the reinforcing bars. This prevents the wire from being loosened and thus the tightening of the wire when the wire is twisted by the twisting device can be carried out efficiently, which makes it sure to be able to bind the reinforcing bars to each other.

Figure 15:
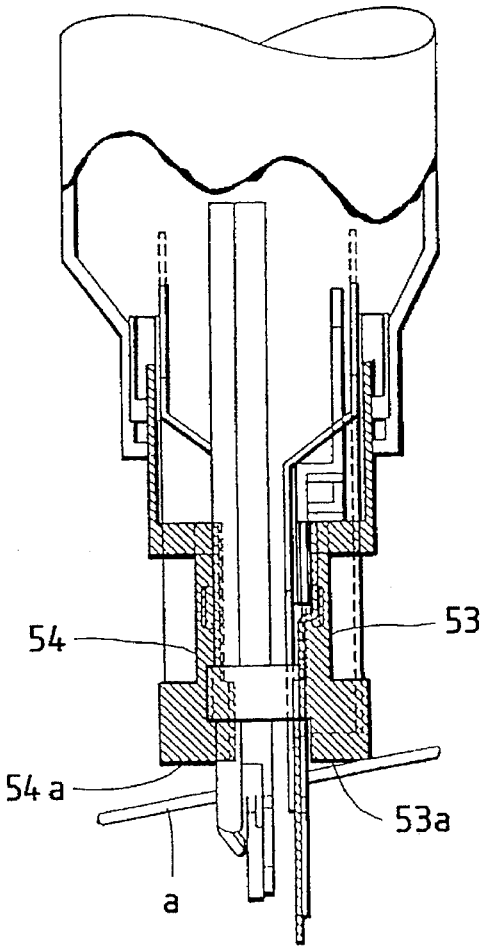

According to the invention, in a structure in which the switches 56 and 57 to be turned on by pressing the contact elements 53 and 54 against the reinforcing bars are connected in series, as in a case shown in FIG. 15, when the binding machine is obliquely pressed against the reinforcing bars so that only one switch 56 can be turned on, the binding machine cannot be operated. This can prevents the reinforcing bars from being bound but imperfectly.

What is claimed is:

1. A safety device for a reinforcing bars binding machine which includes a wire feed device for feeding out a wire used to bind reinforcing bars together, a guide arm for guiding the fed-out wire such that the wire is wound around the intersecting portions of the reinforcing bars in a loop manner, a twisting device for holding part of the loop-wound portion of the wire and for twisting and rotating the same to thereby tighten the wire, and a cutting device for cutting off the loop-wound portion of the wire from the portion of the wire existing on the wire feed device side, wherein said guide arm is movable in the wire feeding direction, and wherein said safety device comprises:

a spring normally energizing the guide arm in the opposite direction to the wire feeding direction; and detecting means for detecting that the guide arm is moved in the wire feeding direction against the energization force of said spring, wherein said wire feeding device is operated in accordance with the detection of the movement of the guide arm by said detecting means.

2. A safety device for a reinforcing bars binding machine in which a wire fed out from a wire feed device is wound around reinforcing bars in a loop manner, and the wire is held and twisted by a twisting hook to thereby tighten the winding of the wire around the reinforcing bars so as to strongly bind the reinforcing bars together, said safety device comprising:

a contact member engageable with the reinforcing bars when the reinforcing bars are to be bound together, said contact member being movable back and forth;

a spring normally energizing said contact member forwardly;

an arm switch which, when said contact member is moved backwardly, is engaged with said contact member; and a trigger switch which is externally operative, wherein the binding machine is able to operate when both said arm switch is engaged and said trigger switch is operated.

3. A safety device for a reinforcing bars binding machine in which a wire fed out from a wire feed device is wound around reinforcing bars in a loop manner, and the wire is held and twisted by a twisting hook to thereby tighten the winding of the wire around the reinforcing bars so as to strongly bind the reinforcing bars together, said safety device comprising:

a contact member engageable with the reinforcing bars when the reinforcing bars are to be bound together, said contact member being movable back and forth;

a spring normally energizing said contact member forwardly; and a switch member which, when said contact member is moved backwardly, is engaged with said contact member to thereby allow the binding machine to be operated;

wherein said contact member comprises two contact elements which are respectively disposed on the right and left sides of said safety device, said switch member comprises two switches which are respectively arranged such that they can be engaged with their respective contact elements, and the binding machine can be operated only when both of said switches are engaged with their respective contact elements.

4. A safety device for a reinforcing bars binding machine in which a wire fed out from a wire feed device is wound around reinforcing bars in a loop manner, and the wire is held and twisted by a twisting hook to thereby tighten the winding of the wire around the reinforcing bars so as to strongly bind the reinforcing bars together, said safety device comprising:

a contact member engageable with the reinforcing bars when the reinforcing bars are to be bound together, said contact member being movable back and forth;

a spring normally energizing said contact member forwardly;

a switch member which, when said contact member is moved backwardly, is engaged with said contact member to thereby allow the binding machine to be operated; and a guide arm individually extending from said contact member, said guide arm constructed and arranged to guide the fed-out wire such that the wire is wound around the intersecting portions of the reinforcing bars in a loop manner.

* * * * *